US008131000B2

(12) United States Patent
Lin

(10) Patent No.: US 8,131,000 B2
(45) Date of Patent: Mar. 6, 2012

(54) COOLING ARRANGEMENT FOR VOICE COIL OF SPEAKER

(75) Inventor: Steff Lin, Taipei Hsien (TW)

(73) Assignee: Hi-Tech Sound System Co., Ltd., Taipei (TW)

( * ) Notice: Subject to any disclaimer, the term of this patent is extended or adjusted under 35 U.S.C. 154(b) by 1237 days.

(21) Appl. No.: 11/889,796

(22) Filed: Aug. 16, 2007

(65) Prior Publication Data

US 2009/0046887 A1 Feb. 19, 2009

(51) Int. Cl.
*H04R 1/00* (2006.01)

(52) U.S. Cl. ..... 381/397

(58) Field of Classification Search ..... 381/397
See application file for complete search history.

(56) References Cited

U.S. PATENT DOCUMENTS

| | | | | |
|---|---|---|---|---|
| 5,850,462 | A * | 12/1998 | Sakamoto et al. | 381/405 |
| 6,810,129 | B2 * | 10/2004 | Nakada | 381/433 |
| 2004/0197007 | A1 * | 10/2004 | Onuma | 381/423 |
| 2006/0088180 | A1 * | 4/2006 | Kaiya et al. | 381/397 |

* cited by examiner

*Primary Examiner* — Alexander Ghyka
*Assistant Examiner* — Stanetta Isaac
(74) *Attorney, Agent, or Firm* — Bacon & Thomas, PLLC

(57) ABSTRACT

A cooling arrangement for voice coil of speaker is disclosed to include a first bearing cup, a second bearing cup inserted into a top opening of the first bearing cup with a top flange thereof stopped at the top side of the first bearing cup to support a voice coil inside the first bewaring cup, and a conical outer holding down cup sleeved onto the first bearing cup to hold down a damper on a bottom flange of the first bearing cup and having a top edge bonded to a cone paper.

1 Claim, 5 Drawing Sheets

COOLING ARRANGEMENT FOR VOICE COIL OF SPEAKER

BACKGROUND OF THE INVENTION

1. Field of the Invention

The present invention relates to speakers and more particularly, to a cooling arrangement for voice coil of speaker, which dissipates heat from the voice coil during operation of the speaker, preventing accumulation of heat energy and avoiding disconnection between the voice coil and the cone paper.

2. Description of the Related Art

FIGS. 1 and 2 show a conventional speaker 1, which comprises a bracket 14, a T-iron 11, an annular magnet 12 supported on the T-iron 11, a washer 13 covered on the magnet 12 opposite to the T-iron 11 and fastened with the magnet 12 and the T-iron 11 to the bottom side of the bracket 14, a voice coil 16 wound round the axle bush at the center of the T-iron 11 and suspending in the magnet 12, a damper 15 inside the bracket 14 around the voice coil 16, a cone paper 17 mounted on the top side of the bracket 14 and fastened to the top end of the axle bush, and a dust cap 18. The voice coil 16 is inserted through the cone paper 17, and then bonded to the damper 15 and the cone paper 17 with a glue. Because the bonding area between the voice coil 16 and the damper 15 is limited, the glue may be melted by heat that is produced during vibration of the voice coil 16, thereby causing disconnection of the voice coil 16 from the damper 15.

Therefore, it is desirable to provide a speaker that eliminates the aforesaid problem.

SUMMARY OF THE INVENTION

The present invention has been accomplished under the circumstances in view. It is therefore the main object of the present invention to provide a cooling arrangement for voice coil of speaker, which dissipates heat quickly from the voice coil during operation of the speaker, preventing accumulation of heat energy and avoiding disconnection between the voice coil and the cone paper.

To achieve this and other objects of the present invention, the cooling arrangement for voice coil of speaker comprises a first bearing cup, which accommodates a voice coil, having a circular opening at its top side thereof and a flange horizontally outwardly extending around the periphery of its bottom side, a second bearing cup, which is inserted through the circular opening of the first bearing cup and the voice coil to support the voice coil inside the first bearing cup, having a flange horizontally outwardly extending around the periphery of its top open side and stopped at the top side of the first bearing cup, and an outer holding down cup, which is sleeved onto the first bearing cup to hold down a damper on the flange of the first bearing cup, having an outer diameter gradually increasing in direction from its bottom side toward its top side thereof and a top edge bonded to a cone paper.

DETAILED DESCRIPTION OF THE PREFERRED EMBODIMENT

Figure 1:
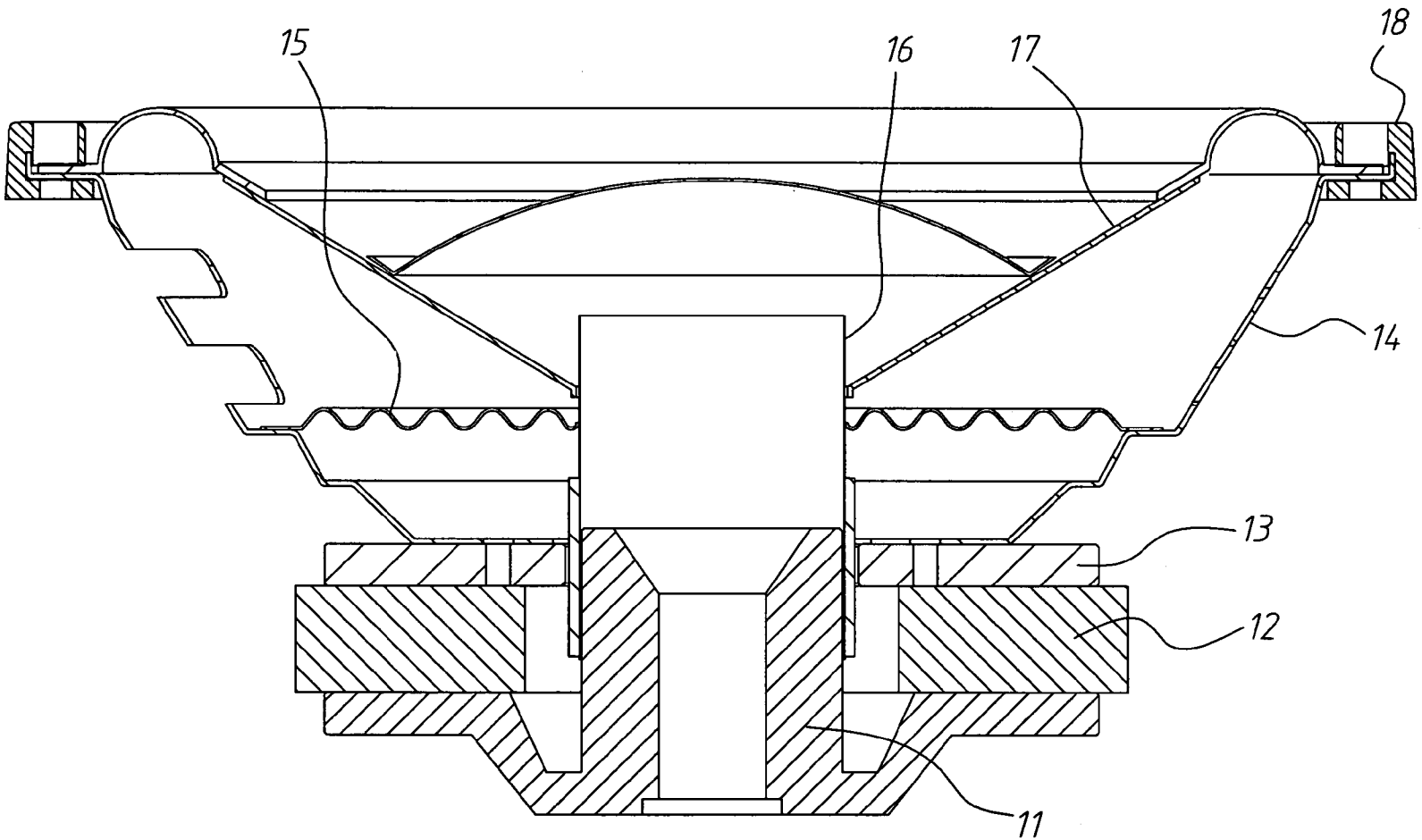
FIG. 1 (Prior Art)
FIG. 1 is a sectional view of a speaker according to the prior art.
Figure 2:
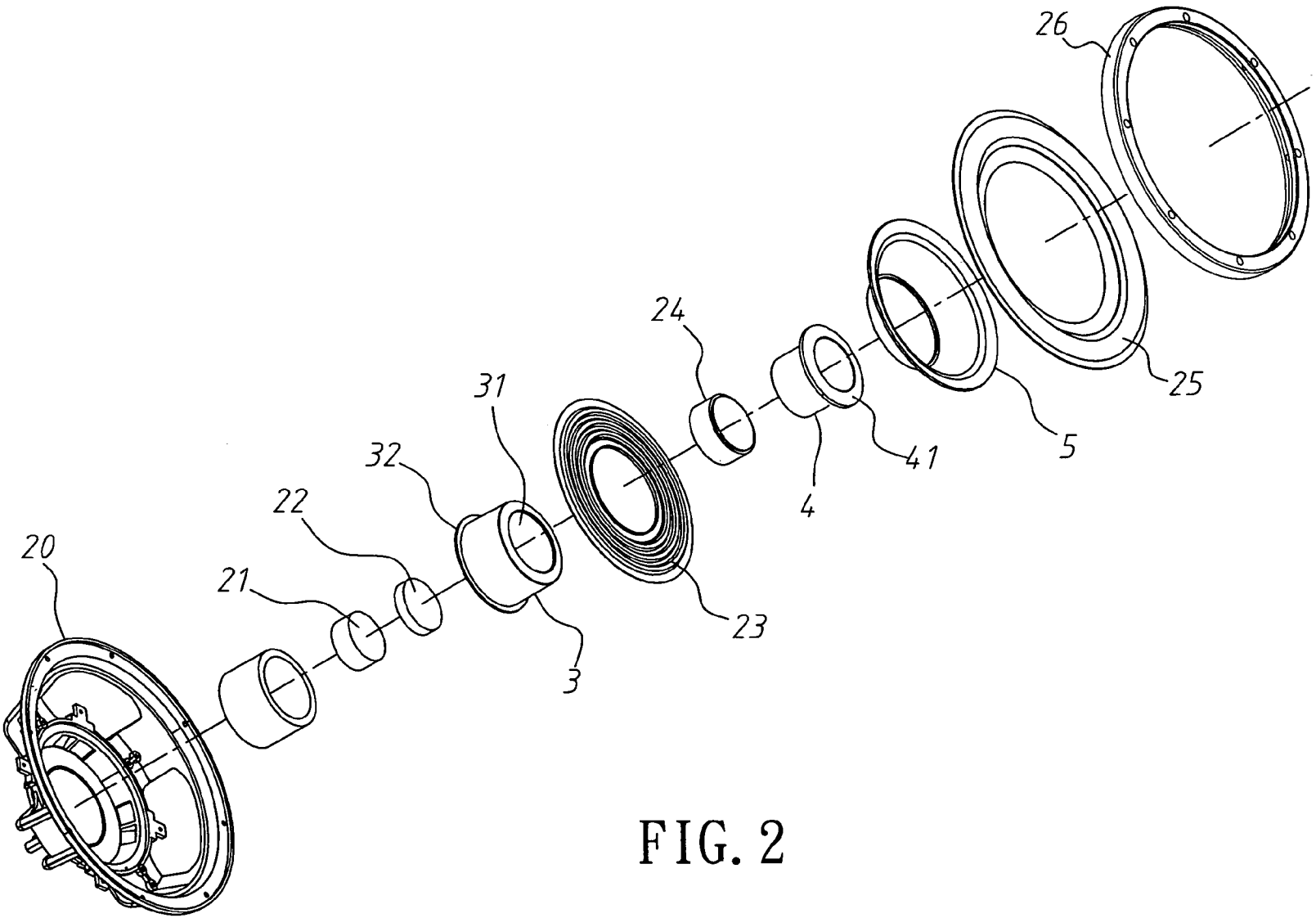
FIG. 2 is an exploded view of a first embodiment of the present invention.
Figure 3:
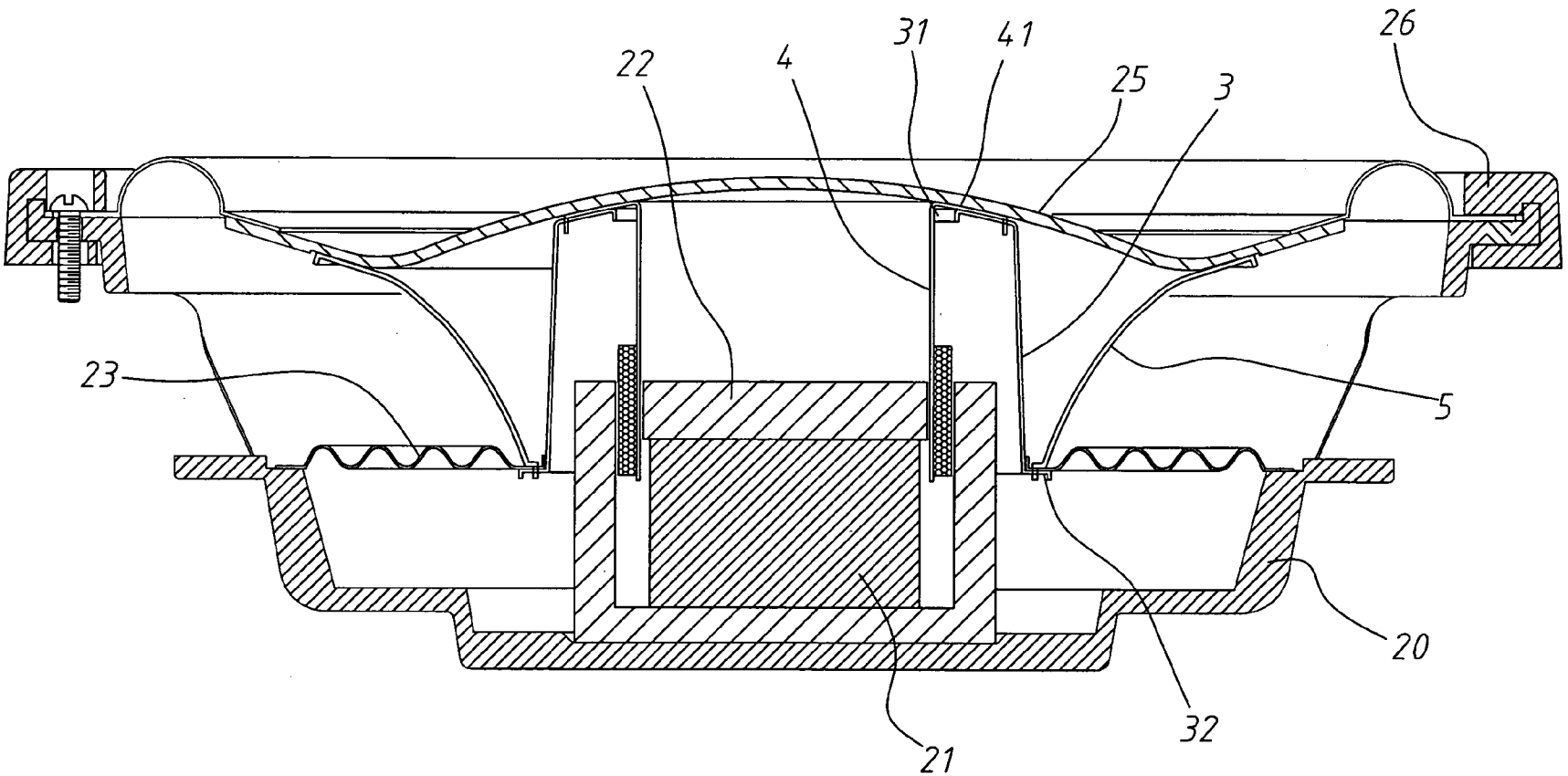
FIG. 3 is a sectional assembly view of the first embodiment of the present invention.

Referring to FIGS. 2 and 3, a speaker constructed according to a first embodiment of the present invention is shown comprising a bracket 20, a magnet 20, a washer 22, a damper 23, a voice coil 24, a cone paper 25, a packing rubber 26, a first bearing cup 3, a second bearing cup 4, and an outer holding down cup 5.

The first bearing cup 3 has a circular opening 31 at the top side, and a flange 32 horizontally outwardly extending around the periphery of the bottom side.

The second bearing cup 4 is a hollow cylinder having a diameter slightly smaller than the opening 31 of the first bearing cup 3 and a flange 41 horizontally outwardly extending around the periphery of its top open side.

The outer holding down cup 5 is conical cup having an outer diameter gradually increasing in direction from its bottom side toward its top side.

The second bearing cup 4 is inserted into the opening 31 of the first bearing cup 3 with its flange 41 stopped at the top side of the first bearing cup 3. The voice coil 24 is sleeved onto the second bearing cup 4 and kept inside the first bearing cup 3. The outer holding down cup 5 is sleeved onto the first bearing cup 3 to hold down the damper 23 on the flange 31 of the first bearing cup 3. The top edge of the outer holding down cup 5 is bonded to the cone paper 25. During operation of the speaker, the first bearing cup 3 and the second bearing cup 4 dissipate heat from the voice coil 24, preventing accumulation of heat energy that may cause disconnection between the voice coil 24 and the cone paper 5.

Figure 4:
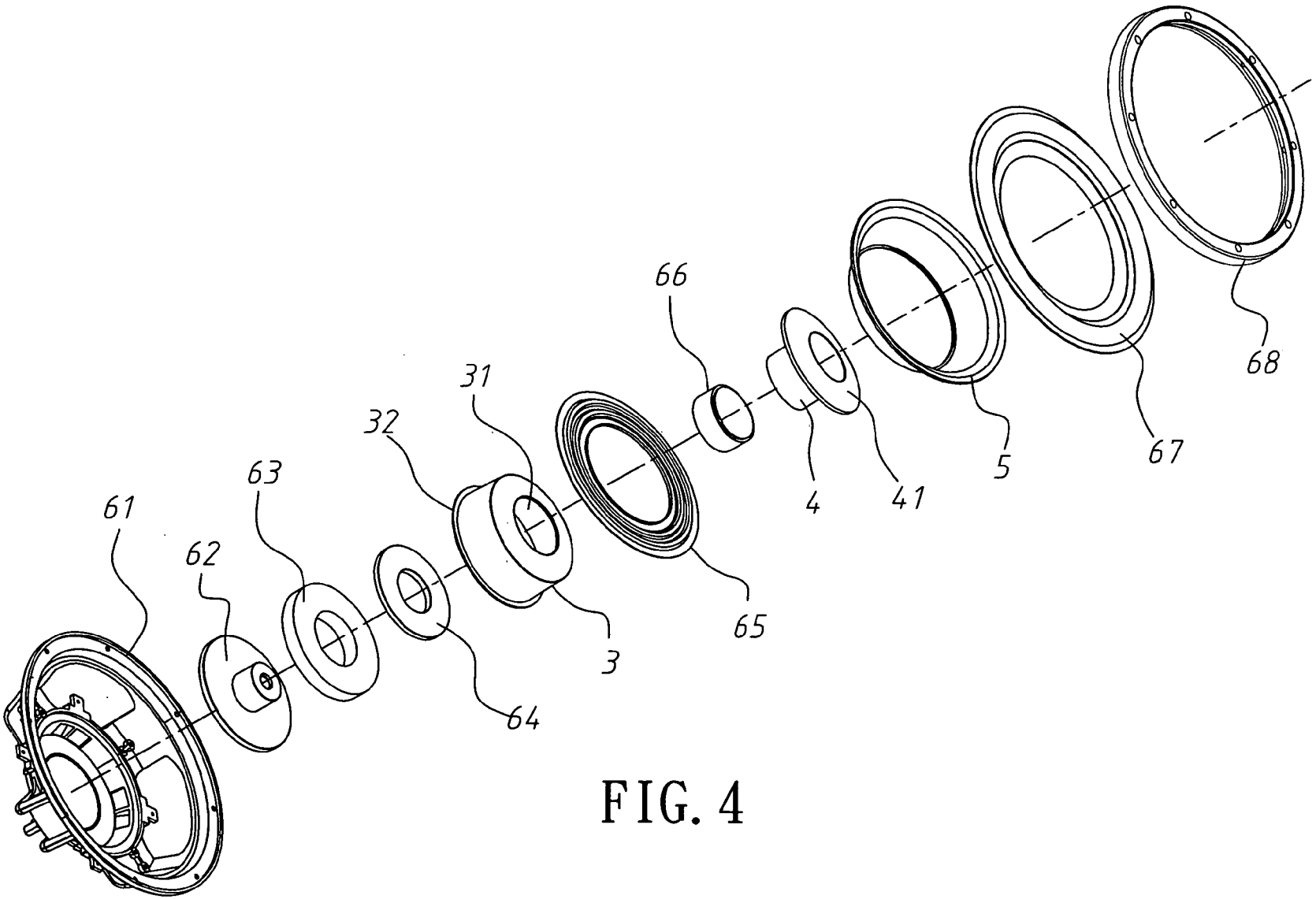
FIG. 4 is an exploded view of a second embodiment of the present invention.
Figure 5:
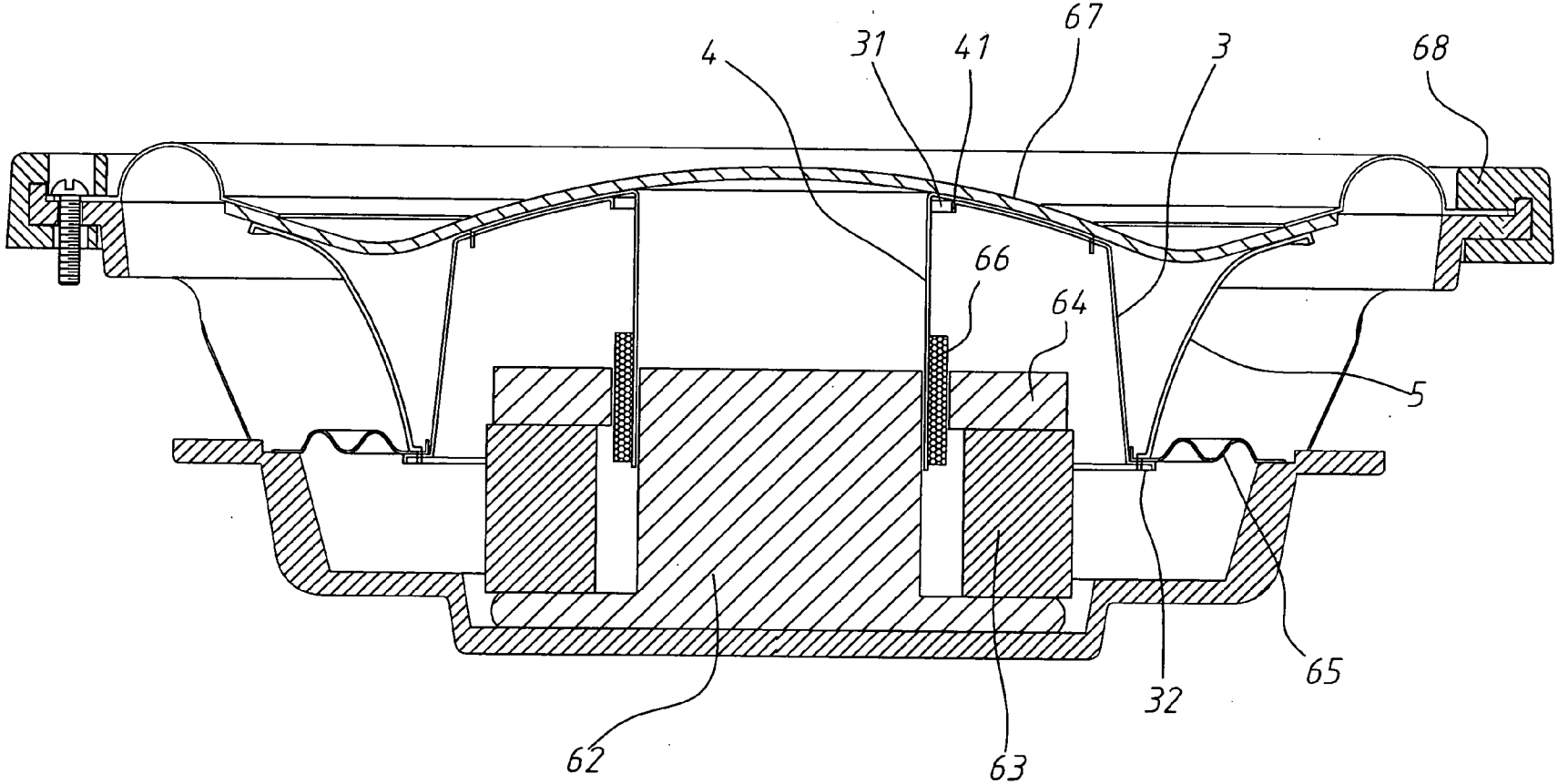
FIG. 5 is a sectional assembly view of the second embodiment of the present invention.

FIGS. 4 and 5 show an alternate form of the present invention. This embodiment comprises an aluminum bracket 61, a T-iron 62, a magnet 63, a washer 64, a damper 65, a voice coil 66, a cone paper 67, a packing rubber 68, a first bearing cup 3, a second bearing cup 4, and an outer holding down cup 5.

The first bearing cup 3 is a circular cup having a circular opening 31 at its top side, a flange 32 horizontally outwardly extending around the periphery of its bottom side.

The second bearing cup 4 is a cylindrical cup having a diameter slightly smaller than the circular opening 31 of the first bearing cup 3, and a flange 41 horizontally outwardly extending around the periphery of its top side.

The outer holding down cup 5 is conical cup having an outer diameter gradually increasing in direction from its bottom side toward its top side.

The second bearing cup 4 is inserted into the opening 31 of the first bearing cup 3 with its flange 41 stopped at the top side of the first bearing cup 3. The voice coil 66 is sleeved onto the second bearing cup 4 and kept inside the first bearing cup 3. The outer holding down cup 5 is sleeved onto the first bearing cup 3 to hold down the damper 65 on the flange 31 of the first bearing cup 3. The top edge of the outer holding down cup 5 is bonded to the cone paper 67. During operation of the speaker, the first bearing cup 3 and the second bearing cup 4 dissipate heat from the voice coil 66, preventing accumulation of heat energy that may cause disconnection between the voice coil 66 and the cone paper 67.

As indicated above, the invention provides a voice coil cooling arrangement, which dissipates heat from the voice coil during operation of the speaker, preventing accumulation of heat energy and avoiding disconnection between the voice coil and the cone paper.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A cooling arrangement for the voice coil of a speaker, comprising:

a first bearing cup accommodating a voice coil, said first bearing cup having a circular opening at a top side thereof and a flange horizontally outwardly extending around the periphery of a bottom side thereof;

a second bearing cup having a flange horizontally outwardly extending around the periphery of a top open side thereof and inserted through the circular opening of said first bearing cup to stop at the top side of said first bearing cup, the voice coil being sleeved onto the second bearing cup and kept inside the first bearing cup; and an outer holding down cup sleeved onto said first bearing cup to hold down a damper on the flange of said first bearing cup, said outer holding down cup having an outer diameter gradually increasing in direction from a bottom side thereof toward a top side thereof and a top edge bonded to a cone paper.

* * * * *